US010079004B2

(12) United States Patent
Yoon et al.

(10) Patent No.: US 10,079,004 B2
(45) Date of Patent: Sep. 18, 2018

(54) DISPLAY CONTROLLER AND DISPLAY SYSTEM INCLUDING THE SAME

(71) Applicant: SAMSUNG ELECTRONICS CO., LTD., Suwon-si (KR)

(72) Inventors: Sung-Chul Yoon, Hwaseong-si (KR); Jong-Ho Roh, Yongin-si (KR); Jae-Sop Kong, Gwacheon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 249 days.

(21) Appl. No.: 14/547,668

(22) Filed: Nov. 19, 2014

(65) Prior Publication Data

US 2015/0213787 A1 Jul. 30, 2015

(30) Foreign Application Priority Data

Jan. 29, 2014 (KR) ..... 10-2014-0011457

(51) Int. Cl.
*G09G 5/391* (2006.01)
*G09G 5/00* (2006.01)

(52) U.S. Cl.
CPC ..... *G09G 5/391* (2013.01); *G09G 5/005* (2013.01); *G09G 5/006* (2013.01); *G09G 2340/0407* (2013.01); *G09G 2350/00* (2013.01); *G09G 2370/04* (2013.01)

(58) Field of Classification Search
None
See application file for complete search history.

(56) References Cited

U.S. PATENT DOCUMENTS 6,232,990 B1 * 5/2001 Poirion ..... G09G 5/363 345/519
6,693,615 B2 2/2004 Hill et al.
6,828,979 B2 12/2004 Brouard et al.
6,894,706 B1 * 5/2005 Ward ..... G06F 3/14 345/428
7,176,876 B2 2/2007 Kabuto et al.
7,586,546 B2 9/2009 Lee et al.
7,973,797 B2 7/2011 Jiao et al.
8,538,201 B2 9/2013 Damkat
9,674,498 B1 * 6/2017 Mukherjee ..... H04N 13/00
(Continued)

FOREIGN PATENT DOCUMENTS

JP 10-178539 A 6/1998
JP 2009-117886 A 5/2009
(Continued)

*Primary Examiner* — Matthew Yeung
(74) *Attorney, Agent, or Firm* — Sughrue Mion, PLLC

(57) ABSTRACT

A display controller includes a scaler which is configured to receive a frame image, scale up the frame image to generate a high resolution frame image based on a quality of the frame image and information about a display device, and output the frame image or the high resolution frame image to the display device for display. A method of controlling image display includes: receiving a frame image; determining whether to scale up the frame image to generate a high resolution frame image based on a quality of the frame image and information about a display device; scaling up the frame image according to a result of the determining; and outputting the frame image or the high resolution frame image for display at the display device.

17 Claims, 14 Drawing Sheets

(56) References Cited

U.S. PATENT DOCUMENTS

| | | | | |
|---|---|---|---|---|
| 2003/0121981 | A1* | 7/2003 | Slutsky | G06K 7/10851 235/462.45 |
| 2004/0217964 | A1* | 11/2004 | Ono | G09G 5/391 345/545 |
| 2010/0110086 | A1* | 5/2010 | Yun | H04N 7/0132 345/520 |
| 2012/0050334 | A1* | 3/2012 | Velthoven | G06T 3/4092 345/660 |
| 2012/0176396 | A1 | 7/2012 | Harper et al. | |
| 2013/0058416 | A1* | 3/2013 | Tsuchiya | H04N 19/105 375/240.16 |
| 2013/0208029 | A1* | 8/2013 | Wu | G09G 3/3611 345/691 |
| 2014/0146229 | A1* | 5/2014 | Hsiao | H04N 5/44591 348/441 |
| 2015/0002739 | A1* | 1/2015 | Rui | H04N 21/440245 348/441 |

FOREIGN PATENT DOCUMENTS

| | | | |
|---|---|---|---|
| JP | 2011-30028 | A | 2/2011 |
| JP | 2011-40974 | A | 2/2011 |
| KR | 10-0723514 | B1 | 5/2007 |

* cited by examiner

DISPLAY CONTROLLER AND DISPLAY SYSTEM INCLUDING THE SAME

CROSS-REFERENCE TO RELATED APPLICATION

This application claims priority from Korean Patent Applications No. 10-2014-0011457, filed on Jan. 29, 2014 in the Korean Intellectual Property Office (KIPO), the content of which is incorporated herein by reference in its entirety.

BACKGROUND

1. Technical Field

Apparatuses and methods consistent with exemplary embodiments relate to a display device, and more particularly to, a display controller and a display system including the display controller.

2. Description of the Related Art

According to development of electronic devices, a display device is required to have higher performance and higher speed. Especially researches about an ultra high definition television are actively being done in connection with a resolution of the display device.

SUMMARY

One or more exemplary embodiments provide a display controller capable of decreasing a bandwidth of a system by placing a scaler behind an image composer.

One or more exemplary embodiments also provide a display system capable of decreasing the bandwidth of the system by placing the scaler behind the image composer.

According an aspect of an exemplary embodiment, there is provided a display controller which may include a scaler which is configured to receive a frame image, scale up the frame image to generate a high resolution frame image based on a quality of the frame image and information about a display device, and output the frame image or the high resolution frame image to the display device for display.

The scaler may not scale up the frame image to generate the high resolution frame image and output the frame image to the display device, if the frame image quality is less than a threshold.

The scaler may scale up the frame image to generate the high resolution frame image based on a display characteristic of the display device, if the frame image equality is not less than the threshold.

The scaler may not scale up the frame image to generate the high resolution frame image and outputs the frame image to the display device, if the frame image equality is not less than the threshold and the display device does not have a predetermined display characteristic.

The scaler may scale up the frame image to generate the high resolution frame image based on whether the display device has a buffer for the frame image, if the frame image equality is not less than the threshold and the display device has the predetermined display characteristic.

The scaler may not scale up the frame image to generate the high resolution frame image and outputs the frame image to the display device, if the frame image equality is not less than the threshold, the display device has the predetermined display characteristic, and the display device has the buffer for the frame image.

The scaler may scale up the frame image to generate the high resolution frame image and outputs the high resolution frame image to the display device, if the frame image equality is not less than the first threshold, the display device has the predetermined display characteristic, and the display device does not have the buffer for the frame image.

The display controller may further include: an information register configured to store information about the frame image quality and the information about the display device; and a controller configured to provide the information about the frame image quality and the display device information to the scaler by controlling the information register.

The controller may change the image quality information and the display device information by controlling the information register.

The scaler may receive a plurality of frame images successively and determine whether to scale up each of the frame images to generate a corresponding high resolution frame image based on a quality of each of the frame images.

According to an aspect of another exemplary embodiment, there is provided a display system which may include a display controller and a display device. The display device may include a scaler. The display controller may be configured to provide a frame image or a first high resolution frame image. The frame buffer buffers the frame image or the high resolution frame image. The scaler may be configured to receive the frame image or the first high resolution frame image, scale up the frame image to generate a second high resolution frame image based on a value of an image quality mode signal, and display the frame image, the first high resolution frame image or the second high resolution frame image for display.

The scaler may receive the frame image if a frame signal is logic low, and receives the first high resolution frame image if the frame signal is logic high.

When the scaler receives the frame image, the scaler may scale up the frame image to generate the second high resolution frame image if the value of the image quality mode signal indicates a high definition among a low definition and the high definition, and may not scale up the frame image and output the frame image for the display if the value of the image quality mode signal indicates the low definition, and when the scaler receives the frame image, the scaler may scale up the frame image to generate the second high resolution frame image if the value of the image quality mode signal indicates a high definition among a low definition and the high definition, and may not scale up the frame image and output the frame image for the display if the value of the image quality mode signal indicates the low definition.

The display system may further include a mode information register configured to store the value of the image quality mode signal. The display device may be configured to receive a plurality of frame images and a plurality of first high resolution frame images, and the value of the image quality mode may be changed for each of the frame images and the first high resolution frame images.

The mode information register may be included in the display device.

BRIEF DESCRIPTION OF THE DRAWINGS

Illustrative, non-limiting exemplary embodiments will be more clearly understood from the following detailed description taken in conjunction with the accompanying drawings.

DETAILED DESCRIPTION OF THE EXEMPLARY EMBODIMENTS

Figure 1:
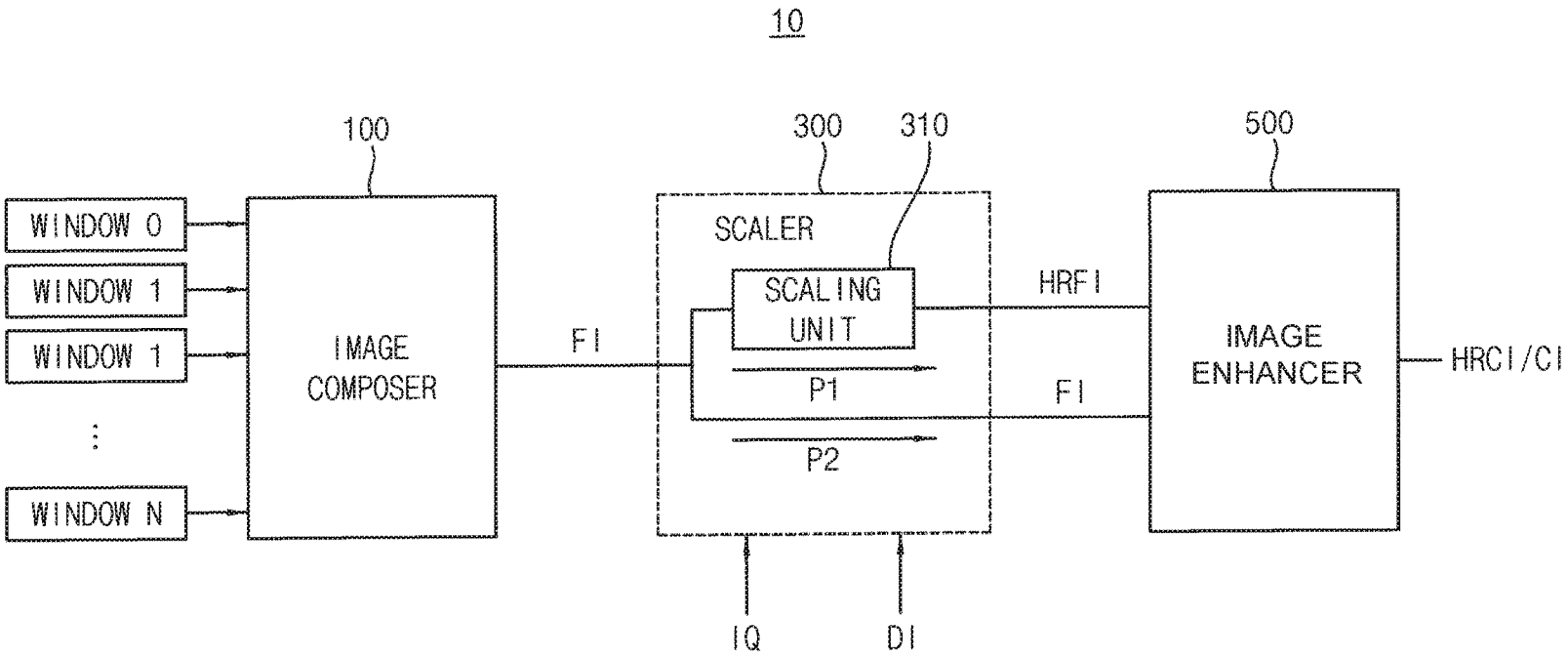
FIG. 1 is a block diagram illustrating a display controller according to an exemplary embodiment.

Various exemplary embodiments will be described more fully hereinafter with reference to the accompanying drawings. The inventive concept may, however, be embodied in many different forms and should not be construed as limited to the exemplary embodiments set forth herein. Rather, these exemplary embodiments are provided so that this disclosure will be thorough and complete, and will fully convey the scope of the inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular exemplary embodiments only and is not intended to be limiting of the inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted in the blocks may occur out of the order noted in the flowcharts. For example, two blocks shown in succession may in fact be executed substantially concurrently or the blocks may sometimes be executed in the reverse order, depending upon the functionality/acts involved.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a display controller according to an exemplary embodiment.

Referring to FIG. 1, a display controller 10 includes an image composer 100, a scaler 300 and an image enhancer 500.

An image composer 100 forms a frame image FI by combining a plurality of windows. For example, the image composer 100 may receive a window 0 WINDOW 0, a window 1 WINDOW 1 . . . and a window N WINDOW N. The image composer 100 may form the frame image FI by combining the window 0 WINDOW 0, the window 1 WINDOW 1, . . . , and the window N WINDOW N.

A scaler 300 provides a high resolution frame image HRFI or the frame image FI by determining whether the frame image FI is to be scaled up, based on an image quality signal IQ and a display device information signal DI. The scaler 300 may include a scaling unit 310. For example, in case that the frame image FI is transferred to the scaling unit 310, the scaling unit 310 may provide the high resolution frame image HRFI.

The scaler 300 may include a path 1 P1 and a path 2 P2. The scaler 300 may determine whether the frame image FI is to be scaled up, based on an image quality signal IQ and a display device information signal DI. For example, in case that scaling of the frame image FI is required according to the image quality signal IQ and the display device information signal DI in the scaler 300, the frame image FI may be transferred to the scaling unit 310 through the path 1 P1 and the scaling unit 310 may transfer the high resolution frame image HRFI to the image enhancer 500. For example, in case that scaling of the frame image FI is not required according to the image quality signal IQ and the display device information signal DI in the scaler 300, the frame image FI may be transferred to the image enhancer 500 through the path 2 P2.

An image enhancer 500 provides a high resolution correction image HRCI or a correction image CI by correcting the high resolution frame image HRFI or the frame image FI. For example, the image enhancer 500 may receive the high resolution frame image HRFI or the frame image FI from the scaler 300. The image enhancer 500 may correct the high resolution frame image HRFI or the frame image FI from the scaler 300. The correction for the high resolution frame image HRFI or the frame image FI in the image enhancer 500 may be performed for improvement of image quality.

The image enhancer 500 may provide the high resolution correction image HRCI or the correction image CI. For example, the high resolution correction image HRCI may be an image that is generated after the correction of the high resolution frame image HRFI is performed. The correction image CI may be an image that is generated after the correction of the frame image FI is performed.

The display controller 10 according to exemplary embodiments may determine whether the frame image FI is to be scaled up based on an image quality signal IQ and a display device information signal DI. As the scaler 300 is placed behind the image composer 100, a system bandwidth may be decreased in front of the scaler 300. Therefore if the display controller 10 according to the current exemplary embodiment is used, the system bandwidth and power consumption may be decreased. The system including the display controller 10 may be efficiently operated.

Figure 2:
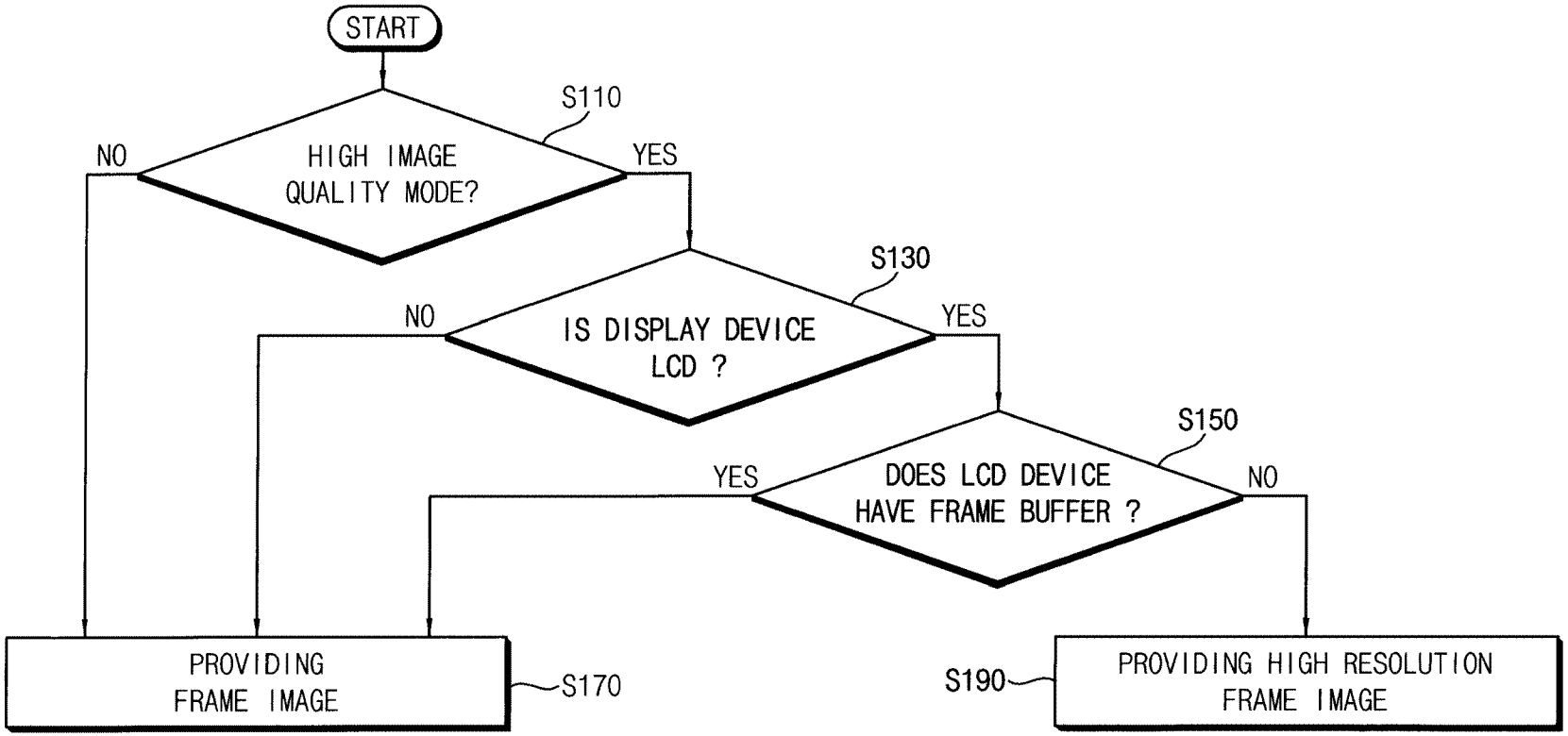
FIG. 2 is a flow chart for describing an operation of the display controller of FIG. 1, according to an exemplary embodiment.

FIG. 2 is a flow chart for describing an operation of the display controller of FIG. 1.

Referring to FIGS. 1 and 2, the display controller 10 may determine whether the frame image FI is to be scaled up based on the image quality signal IQ (S110). The display controller 10 may determine whether the frame image FI is to be scaled up based on the display device information signal DI (S130, S150). The image quality signal IQ may include a high image quality signal HIQ and a low image quality signal LIQ. Display device information DDI included in the display device information signal DI may include display device type information and frame buffer information.

According to an exemplary embodiment, in case that the image quality signal IQ is a first image quality signal IQ, the scaler 300 may provide the frame image FI (S170). The first image quality signal IQ may be the low image quality signal LIQ. In case that the first image quality signal IQ is the low image quality signal LIQ, the scaler 300 may not perform scaling of the frame image FI. Here, the low image quality signal LIQ may indicates that a quality of the frame image FI is less than a predetermined threshold. For example, if an amount of image data included in the frame image FI or a pixel resolution of the frame image FI is less than a predetermined threshold, the low image quality signal LIG may be generated, according to an exemplary embodiment.

For example, In case that the first image quality signal IQ is the low image quality signal LIQ, the frame image FI transferred to the scaler 300 may be provided to the image enhancer 500 through the path 2 P2. The image enhancer 500 may provide the correction image CI by correcting the frame image FI.

According to an exemplary embodiment, in case that the image quality signal IQ is a second image quality signal IQ, the scaler 300 may determine whether the frame image FI is to be scaled up based on display device type information included in the display device information signal DI.

The second image quality signal IQ may be the high image quality signal HIQ. In case that the second image quality signal IQ is the high image quality signal HIQ, the scaler 300 may determine whether the frame image FI is to be scaled up based on the display device information signal DI.

The display device information DDI included in the display device information signal DI may include the display device type information and the frame buffer information. For example, the display device type information may indicate whether a display device type is a liquid crystal display (LCD) or comparable display (hereafter referred to as "LCD"). The frame buffer information may indicate whether a display device include a frame buffer.

For example, to determine whether the frame image FI is to be scaled up, the scaler 300 may identify the display device type information included in the display device information signal DI. The display controller 10 may determine whether the frame image FI is to be scaled up based on the display device type information included in the display device information signal DI (S130).

According to an exemplary embodiment, in case that the display device type information indicates that a display device type is not an LCD, the scaler 300 may provide the frame image FI (S170). In case that the image quality signal IQ is the high image quality signal HIQ and the display device type information indicates that the display device is not the LCD, the scaler 300 may not perform scaling of the frame image FI. Here, the display device type information does not need to specifically indicate whether the display device is an LCD, and instead, may indicate whether a display resolution of the display device is greater than a predetermined threshold, whether the display device is a predetermined type or what characteristics the display device has, according to exemplary embodiments.

For example, in case that the image quality signal IQ is the high image quality signal HIQ and the display device type information indicates that the display device is not the LCD, the frame image FI transferred to the scaler 300 may be provided to the image enhancer 500 through the path 2 P2. The image enhancer 500 may provide the correction image CI by correcting the frame image FI.

According to an exemplary embodiment, in case that the display device type information indicates that the display device type is the LCD, the scaler 300 may determine whether the frame image FI is to be scaled up based on the frame buffer information included in the display device information signal DI.

For example, to determine whether the frame image FI is to be scaled up, the scaler 300 may identify the display device type information included in the display device information signal DI. After that, the scaler 300 may identify the frame buffer information included in the display device information signal DI. The display controller 10 may determine whether the frame image FI is to be scaled up based on the frame buffer information included in the display device information signal DI (S150).

According to an exemplary embodiment, in case that the frame buffer information indicates that a display device does not include a frame buffer, the scaler 300 may provide the high resolution frame image HRFI by scaling up the frame image FI (S190).

For example, in case that the image quality signal IQ is the high image quality signal HIQ, the display device type information indicates that the display device is the LCD and the frame buffer information indicates that the display device does not include the frame buffer, the frame image FI may be transferred to the scaling unit 310 through the path 1 P1 and the scaling unit 310 may transfer the high resolution frame image HRFI to the image enhancer 500. The image enhancer 500 may provide the high resolution correction image HRCI by correcting the high resolution frame image HRFI.

According to an exemplary embodiment, in case that the frame buffer information indicates that a display device includes a frame buffer, the scaler 300 may provide the frame image FI.

For example, in case that the image quality signal IQ is the high image quality signal HIQ, the display device type information indicates that the display device is the LCD and the frame buffer information indicates that the display device includes the frame buffer, the frame image FI may be transferred to the image enhancer 500 through the path 2 P2. The image enhancer 500 may provide the correction image CI by correcting the frame image FI.

In an operation of the display device according to the exemplary embodiment, to determine whether the frame image FI is to be scaled up, the scaler 300 may identify the display device type information included in the display device information signal DI. After that, the scaler 300 may identify the frame buffer information included in the display device information signal DI. However, according to another exemplary embodiment, to determine whether the frame image FI is to be scaled up, the scaler 300 may identify the frame buffer information included in the display device information signal DI. After that, the scaler 300 may identify the display device type information included in the display device information signal DI.

Figure 3:
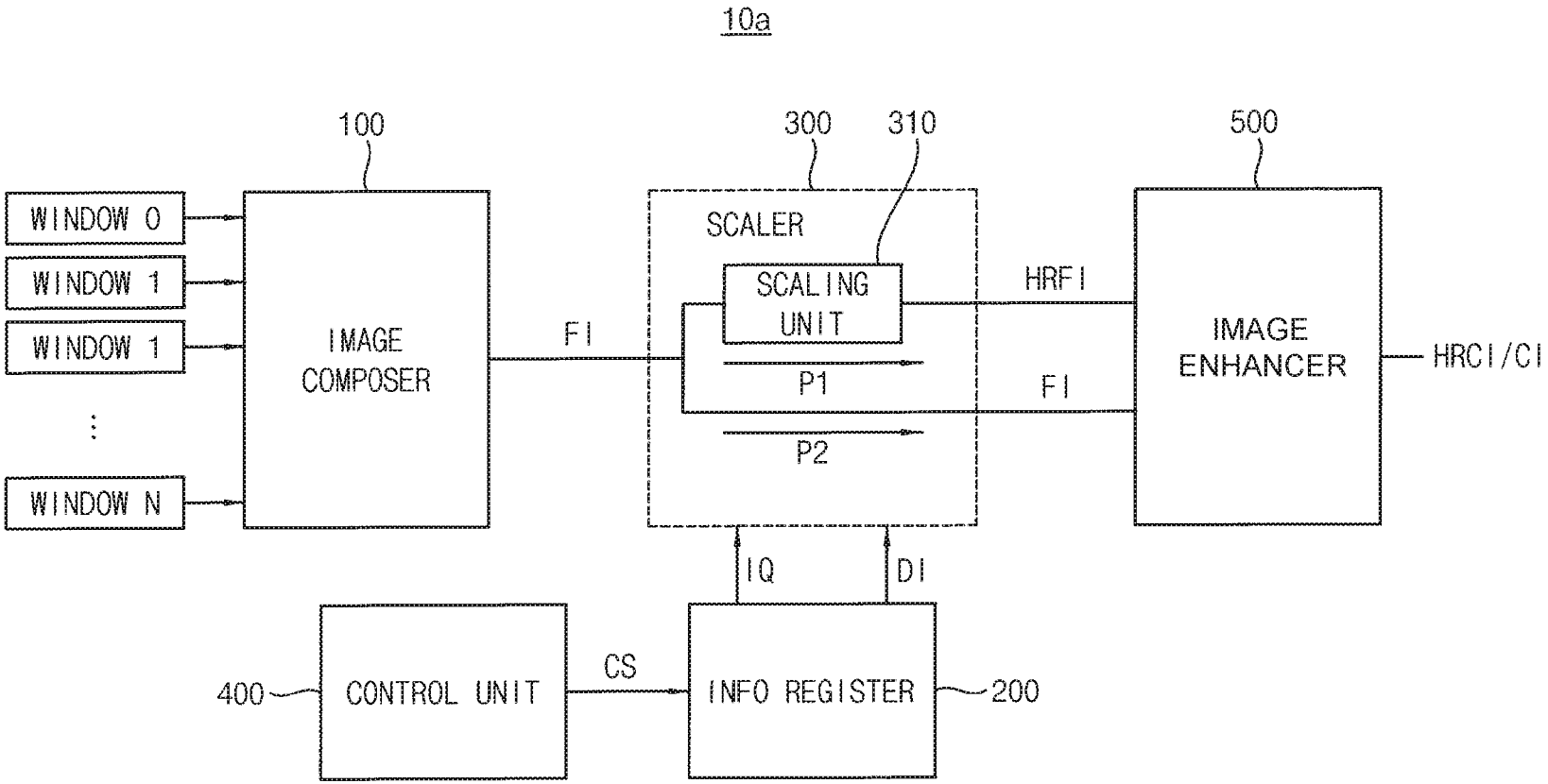
FIG. 3 is a block diagram illustrating a display controller according to an exemplary embodiment.

FIG. 3 is a block diagram illustrating a display controller according to an exemplary embodiment.

Referring to FIG. 3, a display controller 10*a* includes an image composer 100, a scaler 300, an image enhancer 500, an information register 200 and a controller 400.

The image composer 100 forms a frame image FI by combining a plurality of windows. A scaler 300 provides the high resolution frame image HRFI or the frame image FI by determining whether the frame image FI is scaled up based on the image quality signal IQ and the display device information signal DI. The scaler 300 may include a scaling unit 310. The image enhancer 500 provides a high resolution correction image HRCI or a correction image CI by correcting the high resolution frame image HRFI or the frame image FI.

According to an exemplary embodiment, the display controller 10*a* may further include an information register 200 and a controller 400. The information register 200 may store image quality information IQI and display device information DDI. The image quality information IQI may include a first image quality and a second image quality. For example, the first image quality may be a low image quality and the second image quality may be a high image quality.

A controller 400 may provide the image quality signal IQ and the display device information signal DI to the scaler 300 by controlling the information register 200. The image quality signal IQ may correspond to the image quality information IQI. The display device information signal DI may correspond to the display device information DDI. The display device information DDI may include the display device type information and the frame buffer information. The controller 400 may control the information register 200 using the control signal CS. The image quality information IQI may include a first image quality and a second image quality.

For example, in case that the display device type information indicates that a display device type is the LCD, data corresponding to the LCD may be written in the information register 200 corresponding to the display device type information. The controller 400 may provide the display device information signal DI corresponding to the LCD to the scaler 300 by controlling the information register 200 corresponding to the display device type information. For example, in case that the display device type information indicates that a display device type is a display device different from the LCD, data corresponding to this display device may be written in the information register 200 corresponding to the display device type information. The controller 400 may provide the display device information signal DI corresponding to the display device except the LCD to the scaler 300 by controlling the information register 200 corresponding to the display device type information.

For example, in case that the frame buffer information indicates that the display device includes the frame buffer, data corresponding to the display device with the frame buffer may be written in the information register 200 corresponding to the frame buffer information. The controller 400 may provide the display device information signal DI corresponding to the display device with the frame buffer to the scaler 300 by controlling the information register 200 corresponding to the frame buffer information. For example, in case that the frame buffer information indicates that the display device does not include the frame buffer, data corresponding to the display device without the frame buffer may be written in the information register 200 corresponding to the frame buffer information. The controller 400 may provide the display device information signal DI corresponding to the display device without the frame buffer to the scaler 300 by controlling the information register 200 corresponding to the frame buffer information.

For example, in case that the image quality information IQI is the low image quality, data corresponding to the low image quality may be written in the information register 200 corresponding to the image quality information IQI. The controller 400 may provide the image quality signal IQ corresponding to the low image quality to the scaler 300 by controlling the information register 200 corresponding to the image quality information IQI. For example, in case that the image quality information IQI is the high image quality, data corresponding to the high image quality may be written in the information register 200 corresponding to the image quality information IQI. The controller 400 may provide the image quality signal IQ corresponding to the high image quality to the scaler 300 by controlling the information register 200 corresponding to the image quality information IQI.

The scaler 300 provides the high resolution frame image HRFI or the frame image FI by determining whether the frame image FI is scaled up based on the image quality signal IQ and the display device information signal DI. The scaler 300 may include the scaling unit 310. For example, in case that the frame image FI is transferred to the scaling unit 310, the scaling unit 310 may provide the high resolution frame image HRFI.

The scaler 300 may include the path 1 P1 and the path 2 P2. The scaler 300 may determine whether the frame image FI is to be scaled up based on the image quality signal IQ and the display device information signal DI. For example, in case that scaling of the frame image FI is required according to the image quality signal IQ and the display device information signal DI in the scaler 300, the frame image FI may be transferred to the scaling unit 310 through the path 1 P1 and the scaling unit 310 may transfer the high resolution frame image HRFI to the image enhancer 500. For example, in case that scaling of the frame image FI is not required according to the image quality signal IQ and the display device information signal DI in the scaler 300, the frame image FI may be transferred to the image enhancer 500 through the path 2 P2.

The image enhancer 500 may correct the high resolution frame image HRFI or the frame image FI received from the scaler 300. The correction for the high resolution frame image HRFI or the frame image FI in the image enhancer 500 may be performed for improvement of image quality.

The display controller 10*a* according to the above exemplary embodiments may determine whether the frame image FI is to be scaled up based on the image quality signal IQ and the display device information signal DI. As the scaler 300 is placed behind the image composer 100, the system bandwidth may be decreased in front of the scaler 300. Therefore if the display controller 10*a* according to the above exemplary embodiments is used, the system bandwidth and the power consumption may be decreased. The system including the display controller 10*a* may be efficiently operated.

Figure 4:
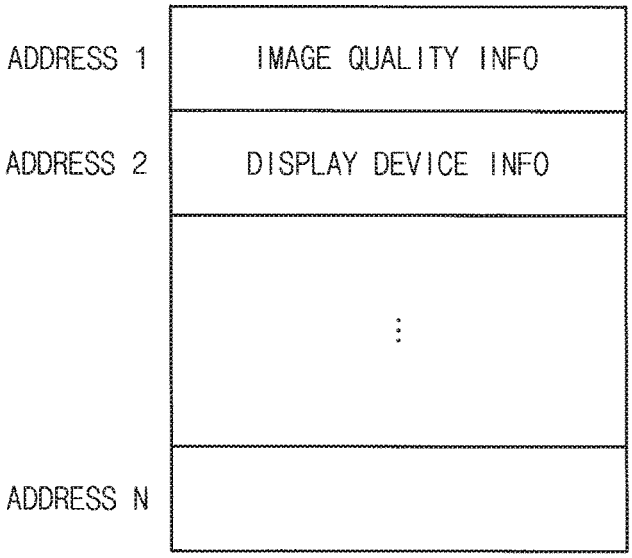
FIG. 4 is a diagram illustrating an example of an information register included in the memory controller of FIG. 3.
Figure 5:
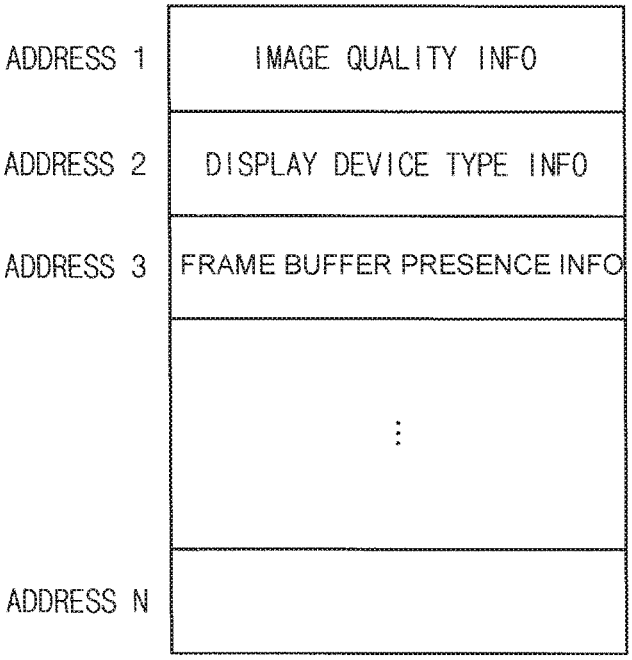
FIG. 5 is a diagram illustrating another example of the information register included in the memory controller of FIG. 3.

FIG. 4 is a diagram illustrating an example of an information register included in the memory controller of FIG. 3 and FIG. 5 is a diagram illustrating another example of the information register included in the memory controller of FIG. 3.

Referring to FIGS. 3 to 5, a display controller 10*a* includes the image composer 100, the scaler 300, the image enhancer 500, the information register 200 and the controller 400.

According to an exemplary embodiment, the controller 400 may change the image quality information IQI and the display device information DDI by controlling the information register 200. For example, the data corresponding to the image quality information IQI may be written in an address 1 of the information register 200. The controller 400 may change the image quality information IQI by controlling the address 1.

For example, the controller 400 may provide the image quality signal IQ corresponding to the image quality to the scaler 300 by controlling the information register 200 corresponding to the image quality information IQI. In case that the image quality signal IQ is a first image quality signal IQ, the scaler 300 may provide the frame image FI. The first image quality signal IQ may be a low image quality signal LIQ. In case that the first image quality signal IQ is the low image quality signal LIQ, the scaler 300 may not perform scaling of the frame image FI. For example, In case that the image quality signal IQ is the low image quality signal LIQ, the frame image FI transferred to the scaler 300 may be provided to the image enhancer 500 through the path 2 P2. The image enhancer 500 may provide the correction image CI by correcting the frame image FI.

For example, in case that the image quality signal IQ is a second image quality signal IQ, the scaler 300 may determine whether the frame image FI is to be scaled up based on the display device type information included in the display device information signal DI. The second image quality signal IQ may be a high image quality signal HIQ. In case that the second image quality signal IQ is the high image quality signal HIQ, the scaler 300 may determine whether the frame image FI is to be scaled up based on the display device information signal DI.

For example, the data corresponding to the display device information DDI may be written in an address 2 of the information register 200. The controller 400 may change the display device information DDI by controlling the address 2. The display device information DDI may include the display device type information and the frame buffer information.

The controller 400 may provide the image quality signal IQ and the display device information signal DI to the scaler 300 by controlling the information register 200. The image quality signal IQ may correspond to the image quality information IQI. The display device information signal DI may correspond to the display device information DDI.

For example, in case that the image quality signal IQ is the high image quality signal HIQ, the display device type information indicates that the display device is the LCD and the frame buffer information indicates that the display device does not include the frame buffer, the frame image FI may be transferred to the scaling unit 310 through the path 1 P1 and the scaling unit 310 may transfer the high resolution frame image HRFI to the image enhancer 500. For example, in case that the image quality signal IQ is the high image quality signal HIQ, the display device type information indicates that the display device is the LCD and the frame buffer information indicates that the display device includes the frame buffer, the frame image FI may be transferred to the image enhancer 500 through the path 2 P2.

For example, the data corresponding to the display device information DDI may be written in an address 1 of the information register 200. The controller 400 may change the display device information DDI by controlling the address 1. The display device information DDI may include the display device type information and the frame buffer information. The data corresponding to the image quality information IQI may be written in an address 2 of the information register 200. The controller 400 may change the image quality information IQI by controlling the address 2.

For example, the data corresponding to the image quality information IQI may be written in an address 1 of the information register 200. The controller 400 may change the image quality information IQI by controlling the address 1. The data corresponding to the display device type information included in the display device information DDI may be written in an address 2 of the information register 200. The controller 400 may change the display device type information included in the display device information DDI by controlling the address 2. The data corresponding to the frame buffer information included in the display device information DDI may be written in an address 3 of the information register 200. The controller 400 may change the frame buffer information included in the display device information DDI by controlling the address 3.

The display controller 10*a* according to exemplary embodiments may determine whether the frame image FI is to be scaled up based on the image quality signal IQ and the display device information signal DI. As the scaler 300 is placed behind the image composer 100, the system bandwidth may be decreased in front of the scaler 300. Therefore if the display controller 10*a* according to the present exemplary embodiments is used, the system bandwidth and the power consumption may be decreased. The system including the display controller 10*a* may be efficiently operated.

Figure 6:
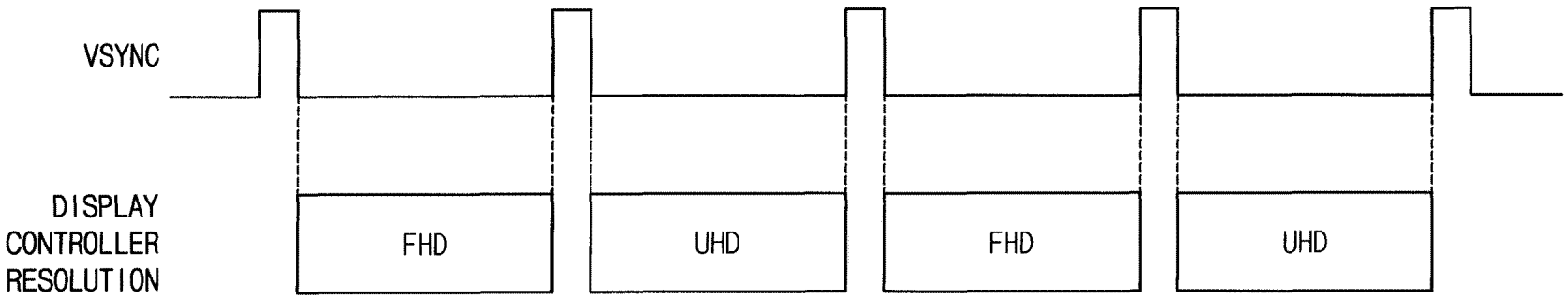
FIG. 6 is a diagram for describing a process of controlling an image quality signal.

FIG. 6 is a diagram for describing a process of controlling an image quality signal, according to an exemplary embodiment.

Referring to FIG. 6, the image quality signal IQ may be controlled by frame. For example, while a frame signal VSYNC is a logic low level in a first interval, the image quality signal IQ may be the low image quality signal LIQ indicating a full high definition (FHD) resolution. While the frame signal VSYNC is the logic low level in a second interval, the image quality signal IQ may be the high image quality signal HIQ indicating an ultra high definition (UHD) resolution. While the frame signal VSYNC is the logic low level in a third interval, the image quality signal IQ may be the low image quality signal LIQ. While the frame signal VSYNC is the logic low level in a fourth interval, the image quality signal IQ may be the high image quality signal HIQ. The image quality signal IQ may be changed by frame.

The image quality signal IQ that is changed by frame may be determined by controlling the information register 200 corresponding to the image quality information IQI. The controller 400 may provide the image quality signal IQ corresponding to the image quality information IQI to the scaler 300 by controlling the information register 200 corresponding to the image quality information IQI.

Figure 7:
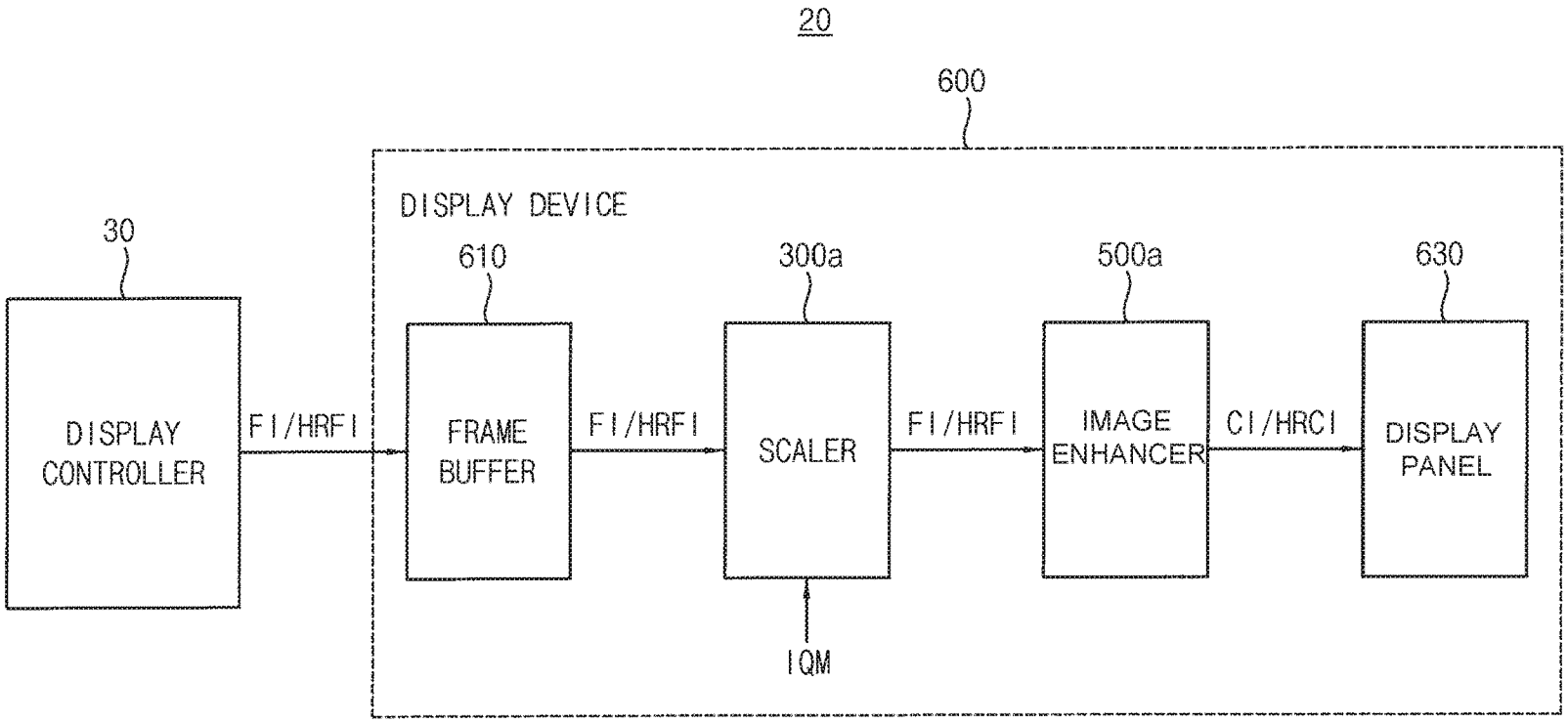
FIG. 7 is a block diagram illustrating a display system according to an exemplary embodiment.
Figure 8:
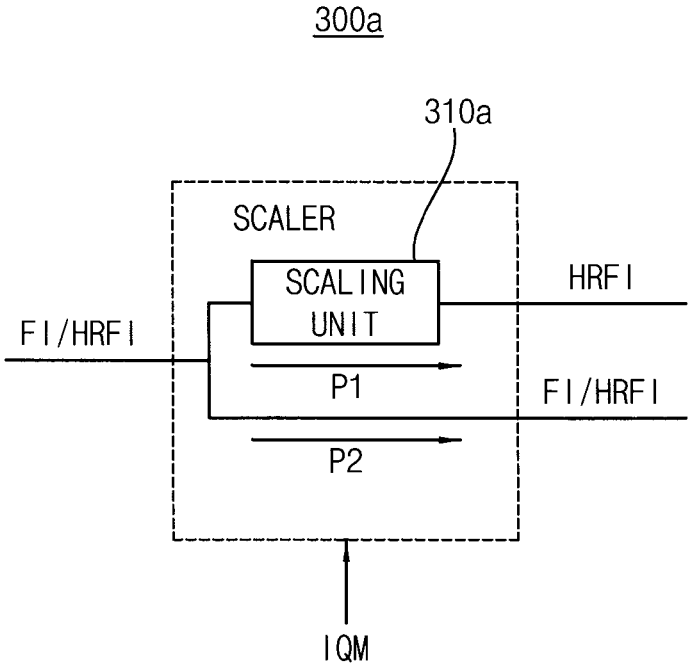
FIG. 8 is a block diagram illustrating an example of a scaler included in the display system of FIG. 7.

FIG. 7 is a block diagram illustrating a display system according to an exemplary embodiment and FIG. 8 is a block diagram illustrating an example of a scaler included in the display system of FIG. 7.

Referring to FIGS. 7 and 8, a display system 20 includes a display controller 30 and a display device 600. The display device 600 includes a frame buffer 610, a scaler 300*a*, an image enhancer 500*a* and a display panel 630.

The display controller 30 provides a frame image FI or a high resolution frame image HRFI. The frame buffer 610 buffers the frame image FI or the high resolution frame image HRFI.

The scaler 300*a* provides the frame image FI or the high resolution frame image HRFI by determining whether the frame image FI or the high resolution frame image HRFI are to be scaled up based on an image quality mode signal IQM.

The scaler 300*a* may include a path 1 P1 and a path 2 P2. The scaler 300*a* may determine whether the frame image FI is to be scaled up based on an image quality mode signal IQM. For example, in case that scaling of the frame image FI is required according to the image quality mode signal IQM in the scaler 300*a*, the frame image FI may be transferred to the scaling unit 310*a* through the path 1 P1 and the scaling unit 310*a* may transfer the high resolution frame image HRFI to the image enhancer 500*a*. For example, in case that scaling of the frame image FI is not required according to the image quality mode signal IQM in the scaler 300*a*, the frame image FI or the high resolution frame image HRFI may be transferred to the image enhancer 500*a* through the path 2 P2.

The image input to the scaler 300*a* may be the frame image FI or the high resolution frame image HRFI.

For example, in case that the image input to the scaler 300*a* is the frame image FI and the image quality mode signal IQM is the low image quality mode signal IQM, the frame image FI transferred to the scaler 300*a* may be provided to the image enhancer 500*a* through the path 2 P2. The image enhancer 500*a* may provide the correction image CI by correcting the frame image FI.

For example, in case that the image input to the scaler 300*a* is the frame image FI and the image quality mode signal IQM is the high image quality mode signal IQM, the frame image FI transferred to the scaler 300*a* may be provided to the image enhancer 500*a* through the path 1 P1. The scaling unit 310*a* may transfer the high resolution frame image HRFI to the image enhancer 500*a*. The image enhancer 500*a* may provide the high resolution correction image HRCI by correcting the high resolution frame image HRFI.

For example, in case that the image input to the scaler 300*a* is the high resolution frame image HRFI and the image quality mode signal IQM is the high image quality mode signal IQM, the high resolution frame image HRFI transferred to the scaler 300*a* may be provided to the image enhancer 500*a* through the path 2 P2. The image enhancer 500*a* may provide the high resolution correction image HRCI by correcting the high resolution frame image HRFI.

The image enhancer 500*a* provides a correction image CI or a high resolution correction image HRCI by correcting the frame image FI or the high resolution frame image HRFI. Correction for the high resolution frame image HRFI or the frame image FI in the image enhancer 500*a* may be performed for improvement of image quality.

The image enhancer 500*a* provides the correction image CI or the high resolution correction image HRCI. For example, the high resolution correction image HRCI may be an image that is generated by correcting the high resolution frame image HRFI. The correction image CI may be an image that is generated by correcting the frame image FI.

The display pane 630 displays the correction image CI or the high resolution correction image HRCI.

The display system 20 according to the above exemplary embodiment may determine whether the frame image FI is to be scaled up based on the image quality mode signal IQM. As the scaler 300*a* is placed behind the image composer 100 (FIG. 1 or 3), a system bandwidth may be decreased in front of the scaler 300*a*. Therefore if the display system 20 according to the above exemplary embodiments is used, the system bandwidth and power consumption may be decreased. The whole system including the display system 20 may be efficiently operated.

Figure 9:
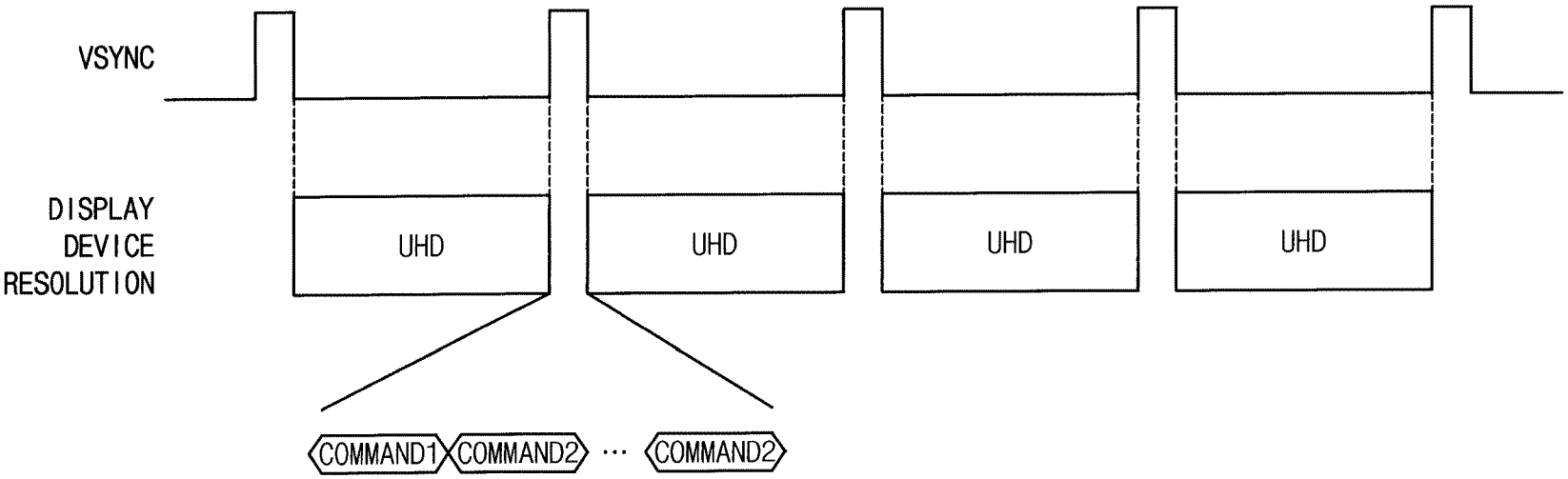
FIG. 9 is a diagram for describing a process of transferring commands including information about an image quality mode in the display system of FIG. 7, according to an exemplary embodiment.

FIG. 9 is a diagram for describing a process of transferring commands including image quality mode information in the display system of FIG. 7, according to an exemplary embodiment.

Referring to FIG. 9, the image quality mode signal IQM may be controlled by frame. The image quality mode information may include a high image quality mode and a low image quality mode. For example, the low image quality mode may be for the FHD resolution and the high image quality mode may be for the UHD resolution.

According to an exemplary embodiment referring to FIG. 9, the image quality mode signal IQM may be controlled by frame. For example, while the frame signal VSYNC is a logic low level in a first interval, the image quality mode signal IQM may be the high image quality mode signal. While the frame signal VSYNC is the logic low level in a second interval, the image quality mode signal IQM may also be the high image mode quality signal. While the frame signal VSYNC is the logic low level in a third interval, the image quality mode signal IQM may still be the high image quality mode signal. While the frame signal VSYNC is the logic low level in a fourth interval, the image quality mode signal IQM may be the high image quality mode signal. The image quality mode signal IQM may be changed by frame.

While the frame signal VSYNC is the logic high level, information about the image quality mode controlled by frame may be transferred from the display controller 30 to the display device 600. The image quality mode information may be included in commands COMMAND 1 TO COMMAND N that are transferred from a memory controller to the display device 600 while the frame signal VSYNC is the logic high level. For example, the first command COMMAND 1 may include the image quality mode information.

According to an exemplary embodiment, while a frame signal VSYNC is logic high, commands COMMAND 1 TO COMMAND N including image quality mode information may be transferred from the display controller 30 to the display device 600.

According to an exemplary embodiment, a mask command may be transferred from the display controller 30 to the display device 600. The mask command may be generated by masking a part of the commands COMMAND 1 TO COMMAND N.

Figure 10:
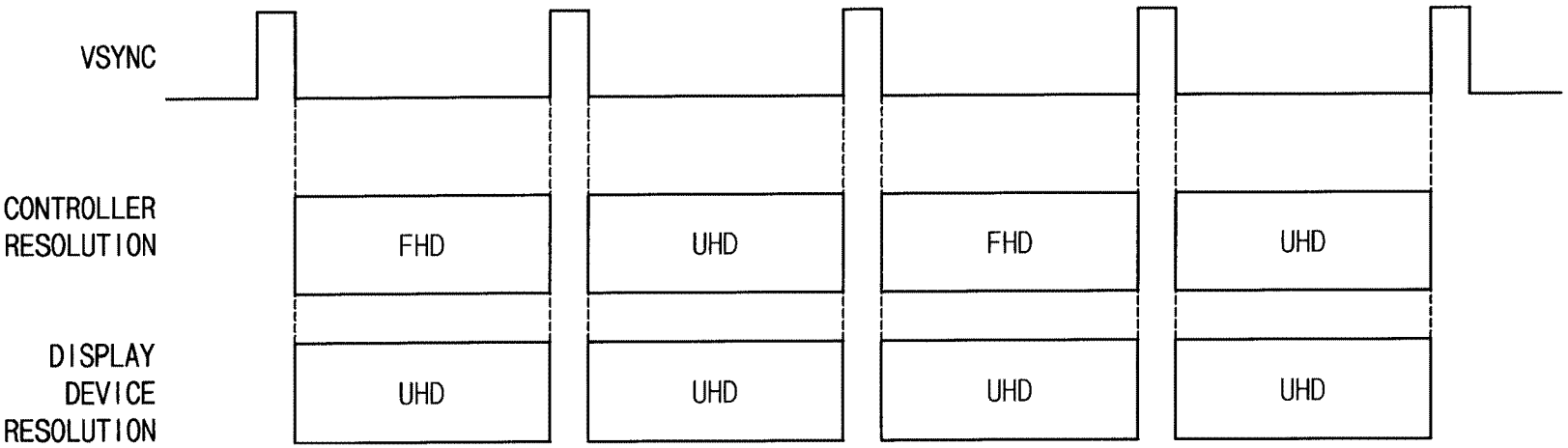
FIG. 10 is a diagram for describing an example of an operation of the display system of FIG. 7.

FIG. 10 is a diagram for describing an exemplary of an operation of the display system of FIG. 7.

Referring to FIGS. 8 and 10, the image quality signal IQ in the display controller 30 may be controlled by frame. The image quality in the display controller 30 may be a high image quality or a low image quality. For example, the low image quality may be the FHD and the high image quality may be the UHD. Also the image quality mode signal IQM in the display device 600 may be controlled by frame. The image quality mode information in the display device 600 may indicate the high image quality mode or the low image quality mode. For example, the low image quality mode may correspond to the FHD and the high image quality mode may correspond to the UHD.

The image quality signal IQ in the display controller 30 may be controlled by frame. For example, while the frame signal VSYNC is a logic low level in a first interval, the image quality signal IQ in the display controller 30 may be the low image quality signal LIQ. In this case, if the image quality mode signal IQM in the display device 600 is the high image quality mode signal IQM, the frame image FI may be transferred to the scaling unit 310*a* through the path 1 P1 and the scaling unit 310*a* may transfer the high resolution frame image HRFI to the image enhancer 500*a*.

For example, while the frame signal VSYNC is the logic low level in a second interval, the image quality signal IQ in the display controller 30 may be the high image quality signal HIQ. In this case, if the image quality mode signal IQM in the display device 600 is the high image quality mode signal IQM, the high resolution frame image HRFI transferred to the scaler 300*a* may be transferred to the image enhancer 500*a* through the path 2 P2.

For example, while the frame signal VSYNC is the logic low level in a third interval, the image quality signal IQ in the display controller 30 may be the low image quality signal LIQ. In this case, if the image quality mode signal IQM in the display device 600 is the high image quality mode signal IQM, the frame image FI may be transferred to the scaling unit 310*a* through the path 1 P1 and the scaling unit 310*a* may transfer the high resolution frame image HRFI to the image enhancer 500*a*.

For example, while the frame signal VSYNC is the logic low level in a fourth interval, the image quality signal IQ in the display controller 30 may be the high image quality signal HIQ. In this case, if the image quality mode signal IQM in the display device 600 is the high image quality mode signal IQM, the high resolution frame image HRFI transferred to the scaler 300*a* may be transferred to the image enhancer 500*a* through the path 2 P2.

The display system 20 according to the above exemplary embodiments may determine whether the frame image FI is to be scaled up based on the image quality mode signal IQM. As the scaler 300*a* is placed behind the image composer 100 (FIG. 1 or 3), a system bandwidth may be decreased in front of the scaler 300*a*. Therefore if the display system 20 according to the above exemplary embodiments is used, the system bandwidth and power consumption may be decreased. The whole system including the display system 20 may be efficiently operated.

Figure 11:
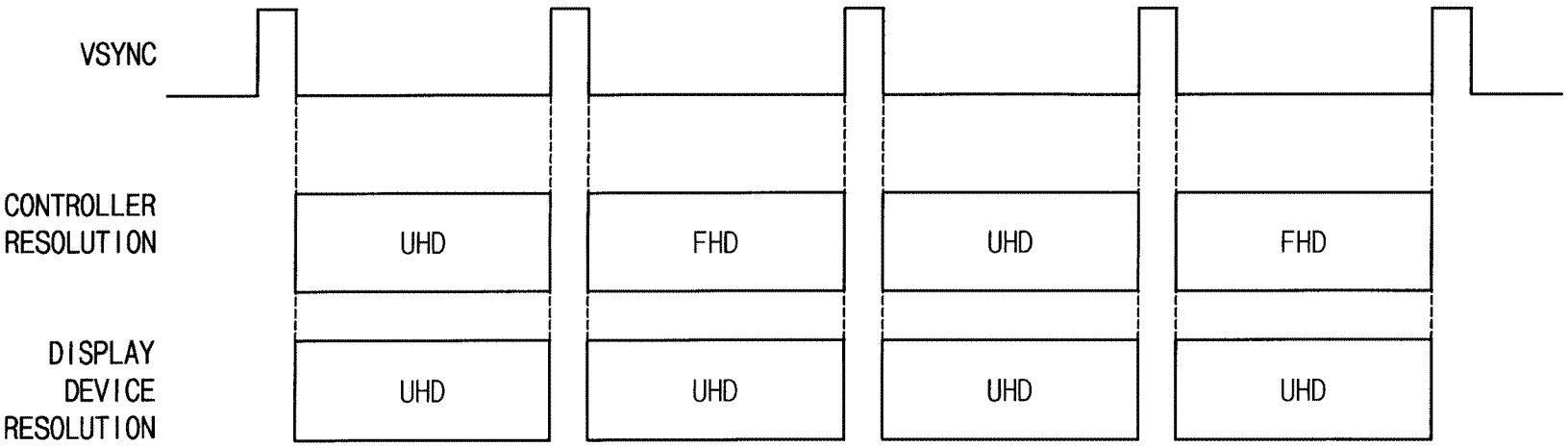
FIG. 11 is a diagram for describing another example of the operation of the display system of FIG. 7.

FIG. 11 is a diagram for describing another example of the operation of the display system of FIG. 7.

Referring to FIGS. 8 and 11, the image quality signal IQ in the display controller 30 may be controlled by frame. For example, while the frame signal VSYNC is a logic low level in the first interval, the image quality signal IQ in the display controller 30 may be the high image quality signal HIQ. In this case, if the image quality mode signal IQM in the display device 600 is the high image quality mode signal IQM, the high resolution frame image HRFI transferred to the scaler 300*a* may be transferred to the image enhancer 500*a* through the path 2 P2.

For example, while the frame signal VSYNC is the logic low level in the second interval, the image quality signal IQ in the display controller 30 may be the low image quality signal LIQ. In this case, if the image quality mode signal IQM in the display device 600 is the high image quality mode signal IQM, the frame image FI may be transferred to the scaling unit 310*a* through the path 1 P1 and the scaling unit 310*a* may transfer the high resolution frame image HRFI to the image enhancer 500*a*.

For example, while the frame signal VSYNC is the logic low level in the third interval, the image quality signal IQ in the display controller 30 may be the high image quality signal HIQ. In this case, if the image quality mode signal IQM in the display device 600 is the high image quality mode signal IQM, the high resolution frame image HRFI transferred to the scaler 300*a* may be transferred to the image enhancer 500*a* through the path 2 P2.

For example, while the frame signal VSYNC is the logic low level in the fourth interval, the image quality signal IQ in the display controller 30 may be the low image quality signal LIQ. In this case, if the image quality mode signal IQM in the display device 600 is the high image quality mode signal IQM, the frame image FI may be transferred to the scaling unit 310*a* through the path 1 P1 and the scaling unit 310*a* may transfer the high resolution frame image HRFI to the image enhancer 500*a*.

Figure 12:
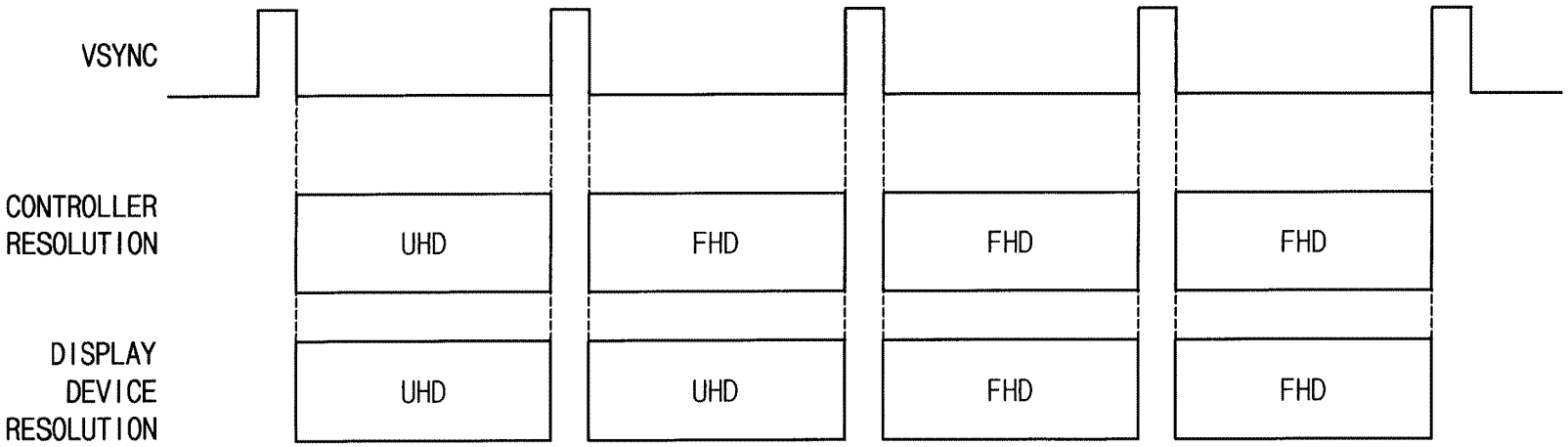
FIG. 12 is a diagram for describing still another example of the operation of the display system of FIG. 7.

FIG. 12 is a diagram for describing still another example of the operation of the display system of FIG. 7.

Referring to FIGS. 8 and 12, while the frame signal VSYNC is a logic low level in the first interval, the image quality signal IQ in the display controller 30 may be the high image quality signal HIQ. In this case, if the image quality mode signal IQM in the display device 600 is the high image quality mode signal IQM, the high resolution frame image HRFI transferred to the scaler 300*a* may be transferred to the image enhancer 500*a* through the path 2 P2.

For example, while the frame signal VSYNC is the logic low level in the second interval, the image quality signal IQ in the display controller 30 may be the low image quality signal LIQ. In this case, if the image quality mode signal IQM in the display device 600 is the high image quality mode signal IQM, the frame image FI may be transferred to the scaling unit 310*a* through the path 1 P1 and the scaling unit 310*a* may transfer the high resolution frame image HRFI to the image enhancer 500*a*.

For example, while the frame signal VSYNC is the logic low level in the third interval, the image quality signal IQ in the display controller 30 may be the low image quality signal LIQ. In this case, if the image quality mode signal IQM in the display device 600 is the low image quality mode signal IQM, the frame image FI transferred to the scaler 300*a* may be transferred to the image enhancer 500*a* through the path 2 P2.

For example, while the frame signal VSYNC is the logic low level in the fourth interval, the image quality signal IQ in the display controller 30 may be the low image quality signal LIQ. In this case, if the image quality mode signal IQM in the display device 600 is the low image quality mode signal IQM, the frame image FI transferred to the scaler 300*a* may be transferred to the image enhancer 500*a* through the path 2 P2.

The display system 20 according to the above exemplary embodiments may determine whether the frame image FI is to be scaled up based on the image quality mode signal IQM. As the scaler 300*a* is placed behind the image composer 100 (FIG. 1 or 3), a system bandwidth may be decreased in front of the scaler 300*a*. Therefore if the display system 20 according to the above exemplary embodiments is used, the system bandwidth and power consumption may be decreased. The whole system including the display system 20 may be efficiently operated.

Figure 13:
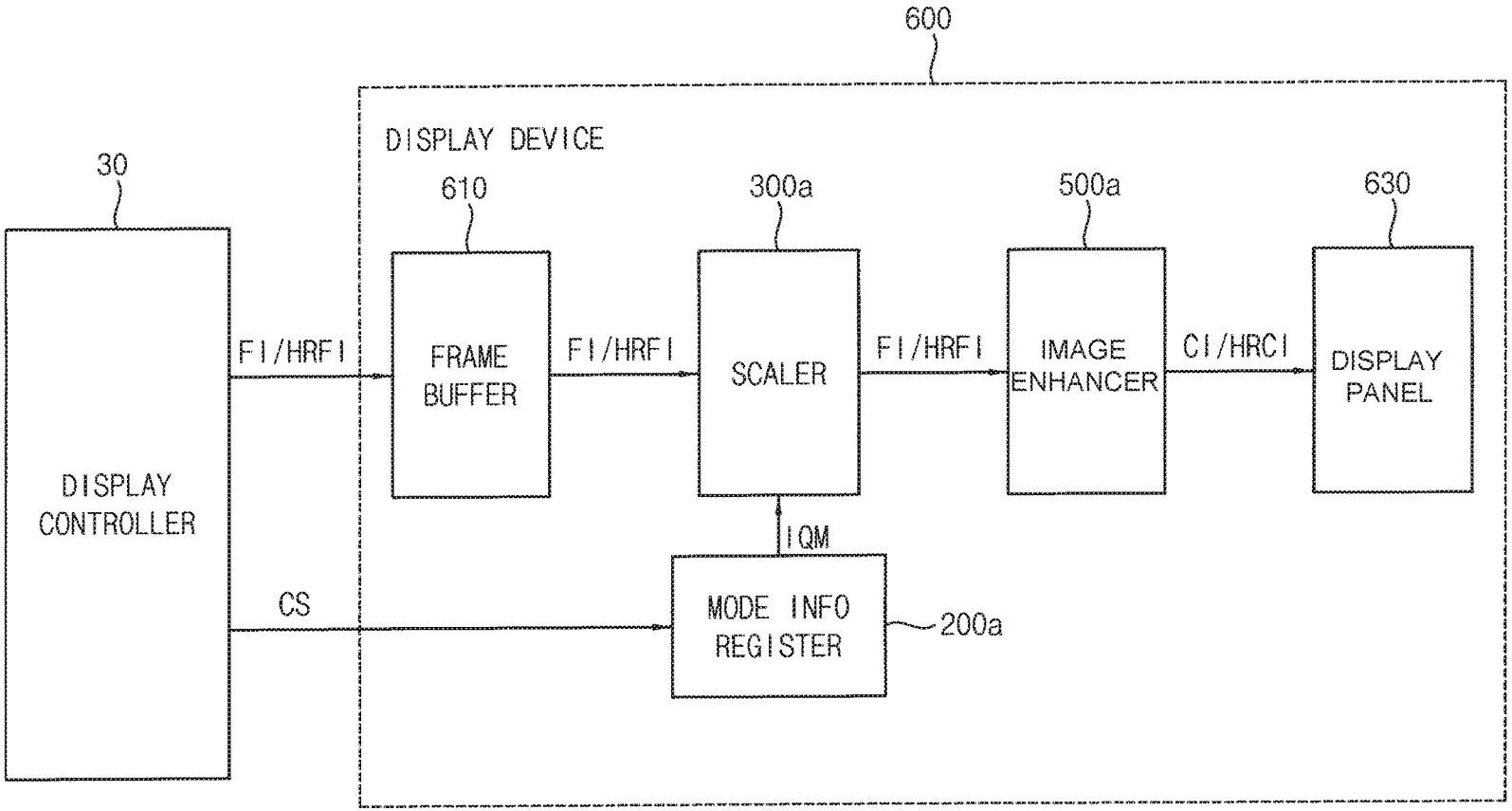
FIG. 13 is a block diagram illustrating a display system according to an exemplary embodiment.

FIG. 13 is a block diagram illustrating a display system according to an exemplary embodiment.

Referring to FIG. 13, a display system 20*a* includes a display controller 30 and a display device 600. The display device 600 includes a frame buffer 610, a scaler 300*a*, an image enhancer 500*a*, a display panel 630 and a mode information register 200*a*.

The display controller 30 provides a frame image FI or a high resolution frame image HRFI. The frame buffer 610 buffers the frame image FI or the high resolution frame image HRFI. The scaler 300*a* provides the frame image FI or the high resolution frame image HRFI by determining whether the frame image FI or the high resolution frame image HRFI is to be scaled up based on an image quality mode signal IQM. The image enhancer 500*a* provides a correction image CI or a high resolution correction image HRCI by correcting the frame image FI or the high resolution frame image HRFI.

The display system 20*a* may further include the mode information register 200*a*.

According to an exemplary embodiment, image quality mode information may be stored in a mode information register 200*a*. As a value of the mode information register 200*a* corresponding to the image quality mode information is changed, the image quality mode signal IQM may be controlled.

The image quality mode information may include a first image quality mode or a second image quality mode. For example, the first image quality mode may be a low image quality mode and the second image quality mode may be a high image quality mode.

For example, in case that the image quality mode information is the low image quality mode, data corresponding to the low image quality mode may be written in the mode information register 200*a* corresponding to the image quality mode information. The display controller 30 may provide the image quality mode signal IQM corresponding to the low image quality mode to the scaler 300*a* by controlling the mode information register 200*a* corresponding to the image quality mode information. The display controller 30 may control the mode information register 200*a* using a control signal CS. For example, in case that the image quality mode information is the high image quality mode, data corresponding to the high image quality mode may be written in the mode information register 200*a* corresponding to the image quality mode information. The display controller 30 may provide the image quality mode signal IQM corresponding to the high image quality mode to the scaler 300*a* by controlling the mode information register 200*a* corresponding to the image quality mode information.

The scaler 300*a* provides the high resolution frame image HRFI or the frame image FI by determining whether the frame image FI is to be scaled up based on the image quality mode signal IQM. The scaler 300*a* may include the scaling unit 310*a*. For example, in case that the frame image FI is transferred to the scaling unit 310*a*, the scaling unit 310*a* may provide the high resolution frame image HRFI.

The scaler 300*a* may include the path 1 P1 and the path 2 P2. The scaler 300*a* may determine whether the frame image FI is to be scaled up based on the image quality mode signal IQM. For example, in case that scaling of the frame image FI is required according to the image quality mode signal IQM in the scaler 300*a*, the frame image FI may be transferred to the scaling unit 310*a* through the path 1 P1 and the scaling unit 310*a* may transfer the high resolution frame image HRFI to the image enhancer 500*a*. For example, in case that scaling of the frame image FI is not required according to the image quality mode signal IQM in the scaler 300*a*, the frame image FI may be transferred to the image enhancer 500*a* through the path 2 P2.

The image enhancer 500*a* may correct the high resolution frame image HRFI or the frame image FI from the scaler 300*a*. Correction for the high resolution frame image HRFI or the frame image FI in the image enhancer 500*a* may be performed for improvement of image quality.

According to an exemplary embodiment, the mode information register 200*a* may be included in the display device 600.

The display system 20*a* according to the above exemplary embodiments may determine whether the frame image FI is to be scaled up based on the image quality mode signal IQM. As the scaler 300*a* is placed behind the image composer 100, a system bandwidth may be decreased in front of the scaler 300*a*. Therefore if the display system 20*a* according to the above exemplary embodiments is used, the system bandwidth and power consumption may be decreased. The whole system including the display system 20*a* may be efficiently operated.

Figure 14:
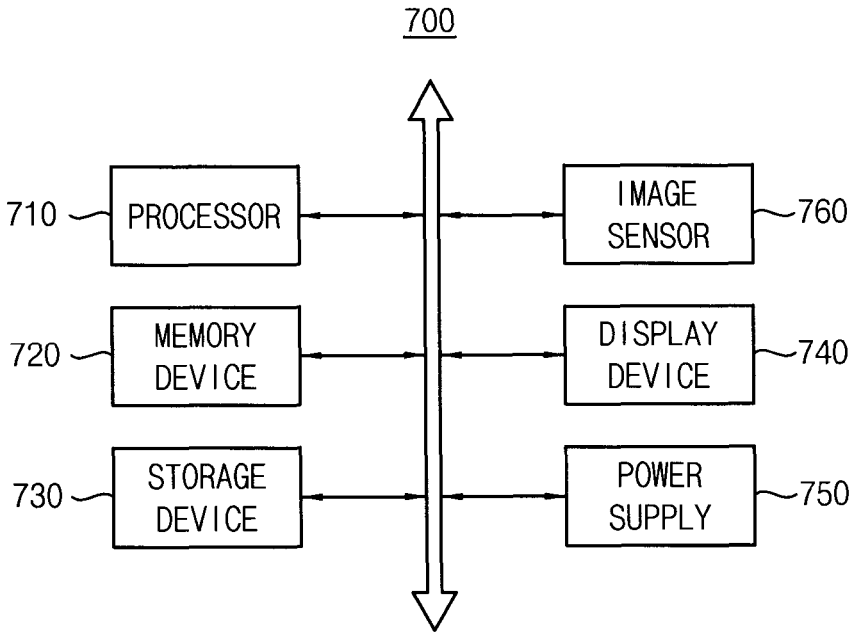
FIG. 14 is a block diagram illustrating a computing system including a display system, according to an exemplary embodiment.

FIG. 14 is a block diagram illustrating a computing system including a display system such as the display system 20*a*, according to an exemplary embodiment.

Referring to FIG. 14, a computing system 700 may include a processor 710, a memory device 720, a storage device 730, a display device 740, a power supply 750 and an image sensor 760. The computing system 700 may further include ports that communicate with a video card, a sound card, a memory card, a universal serial bus (USB) device, other electronic devices, etc. Here, the display device 740 may include the display controller 10 (FIG. 1), the display controller 10*a* (FIG. 3), the display system 20 (FIG. 7) or the display system 20*a* (FIG. 13).

The processor 710 may perform various calculations or tasks. According to an exemplary embodiment, the processor 710 may be a microprocessor or a central processing unit (CPU). The processor 710 may communicate with the memory device 720, the storage device 730, and the display device 740 via an address bus, a control bus, and/or a data bus. According to an exemplary embodiment, the processor 710 may be coupled to an extended bus, such as a peripheral component interconnection (PCI) bus. The memory device 720 may store data for operating the computing system 700. For example, the memory device 720 may be implemented with a dynamic random access memory (DRAM) device, a mobile DRAM device, a static random access memory (SRAM) device, a phase-change random access memory (PRAM) device, a ferroelectric random access memory (FRAM) device, a resistive random access memory (RRAM) device, and/or a magnetic random access memory (MRAM) device. The memory device 720 includes a data loading circuit according to an exemplary embodiment. The storage device 730 may include a solid state drive (SSD), a hard disk drive (HDD), a CD-ROM, etc. The computing system 700 may further include an input device such as a touchscreen, a keyboard, a keypad, a mouse, etc., and an output device such as a printer, a display device, etc. The power supply 750 supplies operation voltages for the computing system 700.

The image sensor 760 may communicate with the processor 710 via the buses or other communication links. The image sensor 760 may be integrated with the processor 710 in one chip, or the image sensor 760 and the processor 710 may be implemented as separate chips.

At least a portion of the computing system 700 may be packaged in various forms, such as package on package (PoP), ball grid arrays (BGAs), chip scale packages (CSPs), plastic leaded chip carrier (PLCC), plastic dual in-line package (PDIP), die in waffle pack, die in wafer form, chip on board (COB), ceramic dual in-line package (CERDIP), plastic metric quad flat pack (MQFP), thin quad flat pack (TQFP), small outline IC (SOIC), shrink small outline package (SSOP), thin small outline package (TSOP), system in package (SIP), multi chip package (MCP), wafer-level fabricated package (WFP), or wafer-level processed stack package (WSP). The computing system 700 may be a digital camera, a mobile phone, a smart phone, a portable multimedia player (PMP), a personal digital assistant (PDA), a computer, etc.

Figure 15:
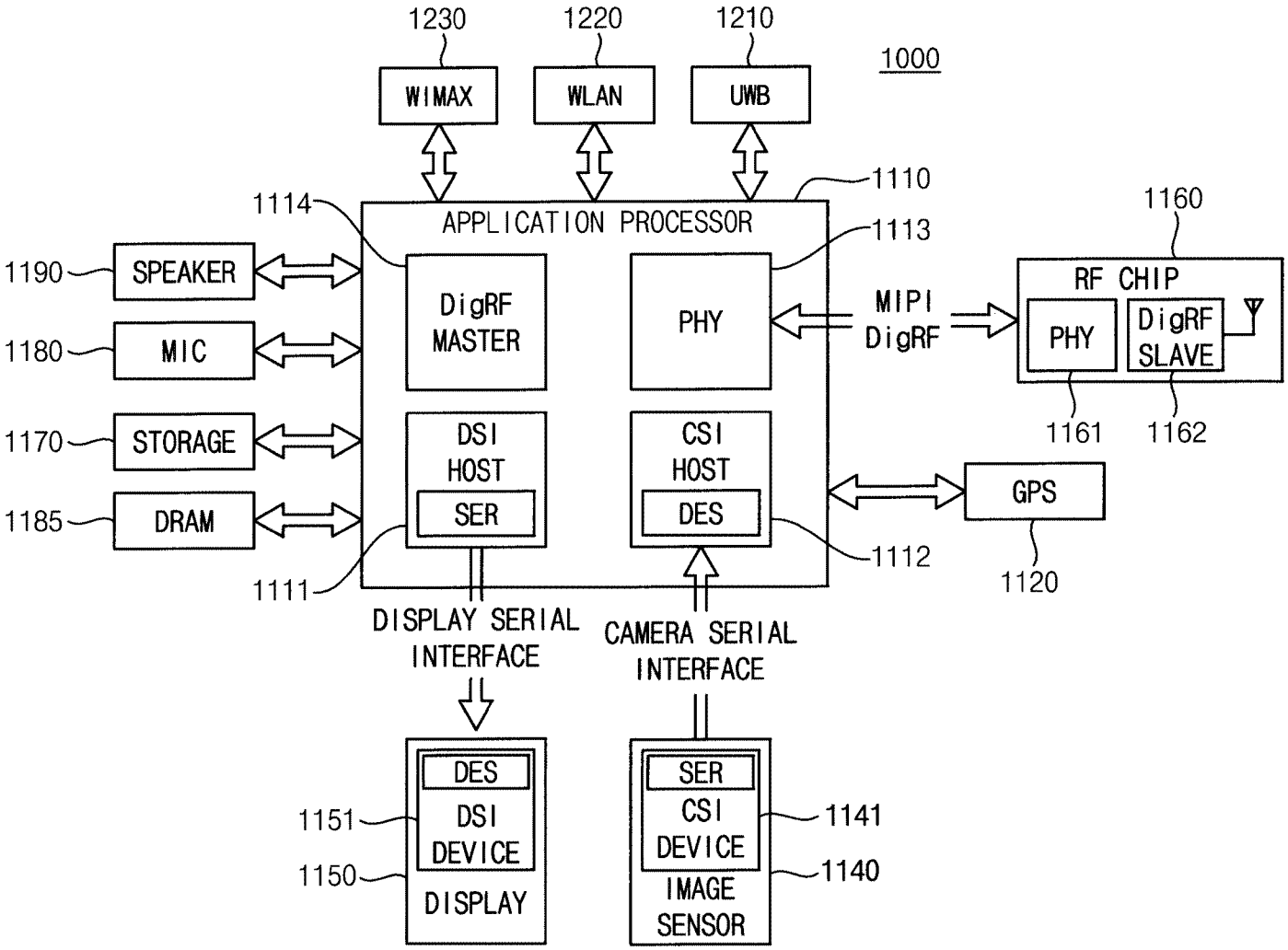
FIG. 15 is a block diagram illustrating an example of an interface used in the computing system of FIG. 14, according to an exemplary embodiment.

FIG. 15 is a block diagram illustrating an example of an interface used in the computing system of FIG. 14, according to an exemplary embodiment.

Referring to FIG. 15, a computing system 1000 may be implemented by a data processing device that uses or supports a mobile industry processor interface (MIPI) interface. The computing system 1000 may include an application processor 1110, an image sensor 1140, a display device 1150, etc. The display device 1150 may correspond to the display device 740 of FIG. 14. A camera serial interface (CSI) host 1112 of the application processor 1110 may perform a serial communication with a CSI device 1141 of the image sensor 1140 via a CSI. According to an exemplary embodiment, the CSI host 1112 may include a deserializer (DES), and the CSI device 1141 may include a serializer (SER). A display serial interface (DSI) host 1111 of the application processor 1110 may perform a serial communication with a DSI device 1151 of the display device 1150 via a DSI.

According to some embodiments, the DSI host 1111 may include a serializer (SER), and the DSI device 1151 may include a deserializer (DES). The computing system 1000 may further include a radio frequency (RF) chip 1160 performing a communication with the application processor 1110. A physical layer (PHY) 1113 of the computing system 1000 and a physical layer (PHY) 1161 of the RF chip 1160 may perform data communications based on a MIPI DigRF. The application processor 1110 may further include a DigRF MASTER 1114 that controls the data communications of the PHY 1161.

The computing system 1000 may further include a global positioning system (GPS) 1120, a storage 1170, a MIC 1180, a DRAM device 1185, and a speaker 1190. In addition, the computing system 1000 may perform communications using an ultra wideband (UWB) 1120, a wireless local area network (WLAN) 1220, a worldwide interoperability for microwave access (WIMAX) 1130, etc. Other structures and interfaces of the electric device 1000 may also be used.

The display system according to the above exemplary embodiments may determine whether the frame image is to be scaled up based on the image quality mode signal. As the scaler is placed behind the image composer, a system bandwidth may be decreased in front of the scaling unit. Therefore if the display system according to the above exemplary embodiments is used, the system bandwidth and power consumption may be decreased. The whole system including the display system may be efficiently operated.

At least one of the components, elements or units represented by a block as illustrated in FIGS. 1, 3, 7 and 13 may be embodied as various numbers of hardware, software and/or firmware structures that execute respective functions described above, according to an exemplary embodiment. For example, at least one of these components, elements or units may use a direct circuit structure, such as a memory, processing, logic, a look-up table, etc. that may execute the respective functions through controls of one or more microprocessors or other control apparatuses. Also, at least one of these components, elements or units may be specifically embodied by a module, a program, or a part of code, which contains one or more executable instructions for performing specified logic functions. Also, at least one of these components, elements or units may further include a processor such as a CPU that performs the respective functions, a microprocessor, or the like.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the inventive concept. Accordingly, all such modifications are intended to be included within the scope of the inventive concept as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the inventive concept.

What is claimed is:

1. A display controller comprising:

an application processor;

an image sensor configured to communicate with the application processor via an address bus, a control bus or other communication links;

an image composer configured to form a frame image;

a scaler configured to receive the frame image, determine whether to scale up the frame image based on image quality information and display device information, and output the frame image or a high resolution frame image that is generated by scaling up the frame image;

an image enhancer configured to receive the frame image or the high resolution frame image, correct the frame image or the high resolution frame image, and provide a correction image or a high resolution correction image;

an information register configured to store the image quality information and the display device information; and a controller configured to provide an image quality information signal and a display device information signal to the scaler by controlling the information register, wherein the correction image is an image generated by correcting the frame image, wherein the high resolution correction image is an image generated by correcting the high resolution frame image, wherein the image quality information signal contains the image quality information, wherein the display device information signal contains the display device information, wherein the scaler does not scale up the frame image to generate the high resolution frame image, and outputs the frame image to the image enhancer, if a resolution of the frame image is less than a threshold, and wherein the scaler scales up the frame image to generate the high resolution frame image, and outputs the high resolution frame image to the image enhancer, if the resolution of the frame image is equal to or greater than the threshold.

2. The display controller of claim 1, wherein the scaler includes a scaling unit, a first path and a second path, wherein the frame image is transferred to the scaling unit through the first path when the frame image is scaled up, and wherein the frame image is transferred to the image enhancer through the second path when the frame image is not scaled up.

3. The display controller of claim 2, wherein the scaling unit provides the high resolution frame image.

4. The display controller of claim 3, wherein the high resolution frame image is transferred to the image enhancer from the scaling unit through the first path.

5. The display controller of claim 1, wherein the controller changes the image quality information and the display device information by controlling the information register.

6. The display controller of claim 1, wherein the image quality information includes a low image quality and a high image quality.

7. The display controller of claim 1, wherein the display device information indicates whether a display device is a liquid crystal display (LCD) or a comparable display.

8. The display controller of claim 1, wherein the image composer forms the frame image by combining a plurality of windows.

9. A display device comprising:

an application processor;

an image sensor configured to communicate with the application processor via an address bus, a control bus or other communication links;

a scaler configured to receive a frame image or a first high resolution frame image, determine whether to scale up the frame image to generate a second high resolution frame image based on an image quality mode signal, and output the frame image, the first high resolution frame image or the second high resolution frame image;

an image enhancer configured to correct the frame image, the first high resolution frame image or the second high resolution frame image, and provide a correction image or a high resolution correction image;

a mode information register configured to store image quality mode information; and a controller configured to provide an image quality information signal and a display device information signal to the scaler by controlling the mode information register, wherein the correction image is an image generated by correcting the frame image, wherein the high resolution correction image is an image generated by correcting the first high resolution frame image or the second high resolution frame image, wherein the image quality mode signal contains the image quality mode information, wherein the scaler does not scale up the frame image to generate the second high resolution frame image, and outputs the frame image to the image enhancer, if a resolution of the frame image is less than a threshold, and wherein the scaler scales up the frame image to generate the second high resolution frame image, and outputs the second high resolution frame image to the image enhancer, if the resolution of the frame image is equal to or greater than the threshold.

10. The display device of claim 9, further comprising a display panel.

11. The display device of claim 9, further comprising a frame buffer configured to store the frame image, the first high resolution frame image or the second high resolution frame image.

12. The display device of claim 9, wherein the scaler includes a scaling unit, a first path and a second path, wherein the frame image is transferred to the scaling unit through the first path when the frame image is scaled up to generate the second high resolution frame image, and wherein the frame image or the first high resolution frame image is transferred to the image enhancer through the second path when the frame image is not scaled up.

13. The display device of claim 12, wherein the second high resolution frame image is transferred to the image enhancer from the scaling unit through the first path.

14. The display device of claim 9, wherein the image quality mode information includes a high image quality mode and a low image quality mode.

15. The display device of claim 14, wherein the high image quality mode is for an ultra-high definition (UHD) resolution, and the low image quality mode is for a full high definition (FHD) resolution.

16. A portable electronic device comprising:

an application processor;

an image sensor configured to communicate with the application processor via an address bus, a control bus or other communication links; and a display device configured to communicate with the application processor via the address bus, the control bus or other communication links, and comprising a display controller that includes:

an image composer configured to form a frame image by combining a plurality of windows;

a scaler configured to receive the frame image, determine whether to scale up the frame image based on image quality information and display device information, and output the frame image or a high resolution frame image that is generated by scaling up the frame image;

an image enhancer configured to receive the frame image or the high resolution frame image, correct the frame image or the high resolution frame image, and provide a correction image or a high resolution correction image;

an information register configured to store the image quality information and the display device information; and a controller configured to control the information register to provide an image quality information signal and a display device information signal to the scaler by controlling the information register, wherein the correction image is an image generated by correcting the frame image, wherein the high resolution correction image is an image generated by correcting the high resolution frame image, wherein the image quality information signal contains the image quality information, wherein the display device information signal contains the display device information, wherein the scaler does not scale up the frame image to generate the high resolution frame image, and outputs the frame image to the image enhancer, if a resolution of the frame image is less than a threshold, and wherein the scaler scales up the frame image to generate the high resolution frame image and outputs the high resolution frame image to the image enhancer, if the resolution of the frame image is equal to or greater than the threshold.

17. The portable electronic device of claim 16, wherein the scaler includes a scaling unit, a first path and a second path, wherein the frame image is transferred to the scaling unit through the first path when the frame image is scaled up, wherein the frame image is transferred to the image enhancer through the second path when the frame image is not scaled up, and wherein the scaling unit provides the high resolution frame image to the image enhancer via the first path.

* * * * *